US005435387A

United States Patent [19]

Roberts

[11] Patent Number: 5,435,387

[45] Date of Patent: Jul. 25, 1995

[54] BUILT-IN GROUT LINE FOR A WELL CASING

[76] Inventor: Jonathan K. Roberts, 11904 Newman Rd., Brighton, Mich. 48116

[21] Appl. No.: 95,411

[22] Filed: Jul. 19, 1993

[51] Int. Cl.[6] ..... E21B 17/18

[52] U.S. Cl. ..... 166/242; 138/114

[58] Field of Search ..... 166/242, 285; 138/111, 138/114

[56] References Cited

U.S. PATENT DOCUMENTS 2,357,589 9/1944 Holmes .
2,479,394 8/1949 Montgomery .
2,591,807 4/1952 Greene .
2,662,602 12/1953 Schnitter .
3,354,659 11/1967 Lehmann .
3,461,960 8/1969 Wilson .
3,492,823 2/1970 Lamberton .
3,844,345 10/1974 Evans et al. ..... 166/242 X
4,649,995 3/1987 Read ..... 166/242

*Primary Examiner*—William P. Neuder
*Attorney, Agent, or Firm*—Gifford, Krass, Groh, Sprinkle, Patmore, Anderson & Citkowski

[57] ABSTRACT

A combination well casing and grout line for grouting the area of a hole dug for a well between the well casing and the sides of the hole. A number of well casing sections connect end-to-end. Each well casing section is provided with at least one grout line which extends the longitudinal length of the well casing section. The grout line forms a continuous channel upon assembly of the well casing sections and permits a grouting material to fill the remaining open area in the hole outside of the well casing progressively from the bottom to the top.

18 Claims, 3 Drawing Sheets

BUILT-IN GROUT LINE FOR A WELL CASING

BACKGROUND OF THE INVENTION

1. Field of the Invention

The present invention relates to the securing of well casings used in underground wells and, more particularly, to a built-in grout line attached to a well casing which permits the grout to be filled in from the bottom of the hole dug for the well.

2. Description of the Prior Art

The present invention is concerned with the securing of a well casing within a hole dug for a well, most commonly a water well. Such wells can be upwards of 200 feet deep and require a reliable manner for securing and sealing the well casing which is inserted into the hole dug for the well.

Previous to this invention, the preferred manner for grouting the area between the outer wall of the casing and the hole consisted of inserting a hose in the remaining area of the hole after the well casing is set in place. The grout is then injected through the hose. Current standards require that the grout be filled in from the bottom of the hole to the top. Therefore, the hose must be constantly repositioned so as to ensure proper application of the grout. This procedure requires constant supervision and is very time consuming.

SUMMARY OF THE PRESENT INVENTION

The present invention is a well casing having a built-in grout line for enabling the filling of grout from the bottom of the well without the requirement of manual supervision. A number of well casing sections are provided each given section being attachable to a successive section.

In a first preferred embodiment a separate grout line is attached to each well casing section. The grout lines are configured similarly to the respective well casing sections and are inter-attachable with one another in the same manner as the well casing sections so as to create a continuous grout line extending the entire length of the overall well casing. The grout is then injected through the grout line from the top once the well casing is positioned in the hole The grout fills the entire annulus around the well casing from the bottom to the top without manual operation or supervision.

In a further preferred embodiment, the grout line can be built into the walls of the well casing sections, about the diameter of the respective casing sections. In this embodiment the grout line consists of a plurality of channels formed about the diameter of each of the well casing sections and extending the axial length of the well casing sections. The grout channels of a given well casing section are aligned with the channels of a succeeding section while the well casing is being assembled. A number of coupling elements are used to interconnect the succeeding well casing sections. The coupling elements each have channels formed about their diameter and align with the channels in the respective casing sections upon assembly. Once the assembly is completed, the grout is injected through the plurality of channels to fill the area between the well casing and the hole.

BRIEF DESCRIPTION OF THE DRAWINGS

A better understanding of the present invention will be had upon reference to the following detailed description, when read in conjunction with the accompanying drawing, wherein like reference characters refer to like parts throughout the several views, and in which.

DESCRIPTION OF THE PREFERRED EMBODIMENTS

Figure 1:
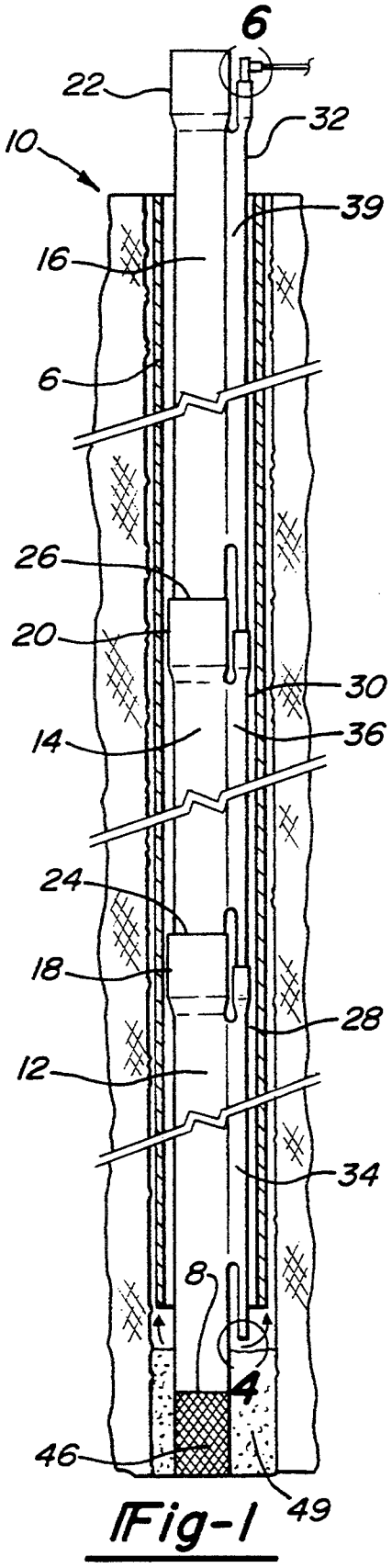
FIG. 1 is an overall view of the assembled grout line for a series of well casings according to a first preferred embodiment of the present invention.
Figure 2:
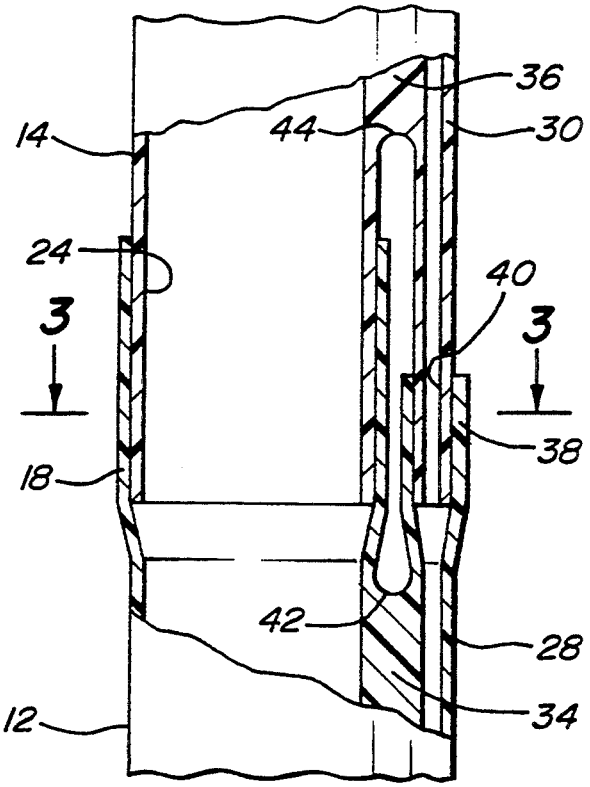
FIG. 2 is a sectional view in cutaway, of a portion of the view shown in FIG. 1 and showing the interattachment between well casing sections and grout lines.
Figure 3:
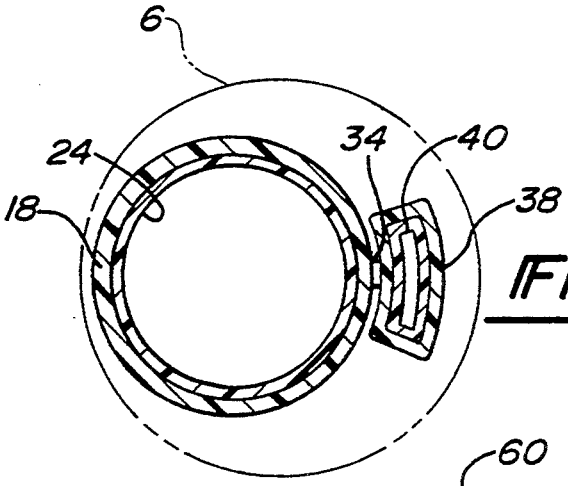
FIG. 3 is a cross sectional view taken along line 3—3 of FIG. 2 and showing the grout line in relation to the well casing.

Referring to FIGS. 1–3, there is shown a grout line and well casing arrangement 10 which enables a grout to be injected into the open space between the outside of the well casing and a hole 6 which is drilled for the well.

A plurality of well casing sections are shown and are designated as 12, 14 and 16. The casing sections are constructed of any desirable material that is sturdy and resilient in use A favored material now being used is a synthetic polymer known as polyvinyl chloride (PVC). The casing sections 12–16 may be of any desired length and are configured so as to be successively attachable end to end to provide the desired length of casing. While only three casing sections 12–16 are shown, it is understood that as many casing sections as are needed may be used to provide the desired length. It is also customary in the industry that wells may be drilled to depths of up to 200 feet or greater, thus necessitating the Use of several successive casing sections.

Each of the well casing sections 12–16 has an outwardly-flared end portion, designated as 18, 20 and 22, respectively. The flared end portion 18 of casing section 12 receives a bottom 24 of the casing section 14. Subsequently, the flared end portion 20 of casing section 14 receives a bottom 26 of the casing section 16 and so on until a desired number of casing sections are assembled to arrive at the proper depth for the well. A suitable cement or bonding adhesive, not shown, is used to secure the bottoms 24 and 26 of casing sections 14 and 16 within the outwardly-flared ends 18 and 20 of casing section 12 and 14.

Referring again to FIGS. 1–3, a built-in grout line of the present invention is shown, with grout lines 28, 30 and 32 being formed integrally with casing sections 12, 14 and 16, respectively. The grout lines are preferably constructed from the same material as the casing sections. The grout line 28 is connected by a flange 34 of the casing section 12. Similarly, grouping lines 30 and 32 are connected by flanges 36 and 39 of casing sections 14 and 16.

Figure 5:
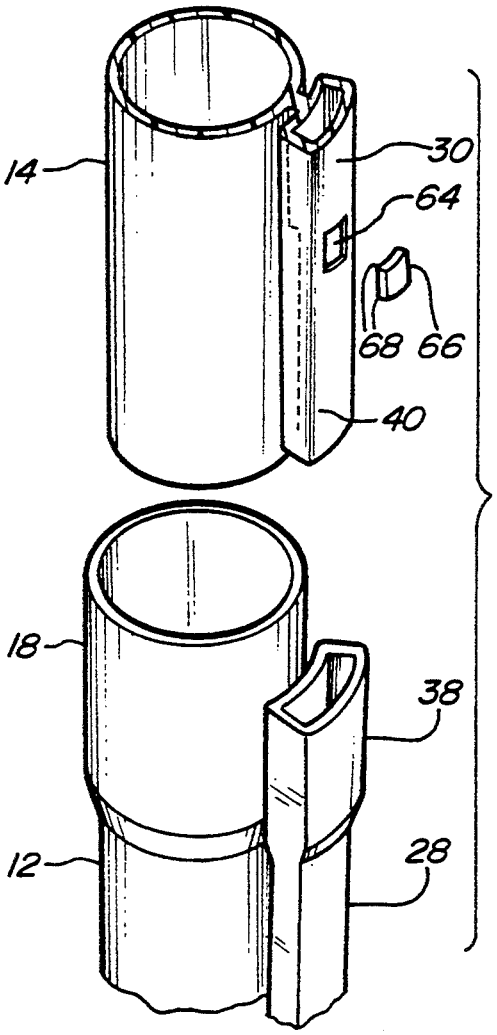
FIG. 5 is an elevated view, in section, and showing the manner in which successive casing sections with attached grout lines are attached.

Referring again to FIGS. 2 and 3 and to FIG. 5, the grout line 28 has an outwardly-flared end portion 38 similar to the outwardly flared end 18 of the casing portion 12. Upon insertion of the casing section 14 within the casing section 12, as previously described, a bottom portion 40 of the grout line 30 is received within the flared end portion 38 of grout line 28. The flanges 34 and 36 of casing sections 12 and 14 do not extend the entire length of the grout lines 28 and 30 and terminate at ends 42 and 44, respectively. The termination of the flange at ends 42 and 44 enables the bottom 40 of grout line 30 to be slidably inserted into the flared end 38 of the grout line 28. In this fashion, the grout lines may be successively assembled concurrent with the assembly of the well casing sections so as to create a continuous channel for the grout line parallel to the open interior of the assembled well casing sections.

Referring again to FIG. 1 the bottom-most well casing portion 12 extends a distance beyond a bottom 8 of the hole 6 for receiving the grouting material. A screen 46 identical to the cross-sectional shape of the well casing is secured to the bottom of the well casing section 12 and extends downwardly. The area surrounding the screen is packed with sand 49. The grouting material is filled in from the surface of the sand which defines the bottom 8 and the sand prevents the grout from permeating the screen.

Figure 4:
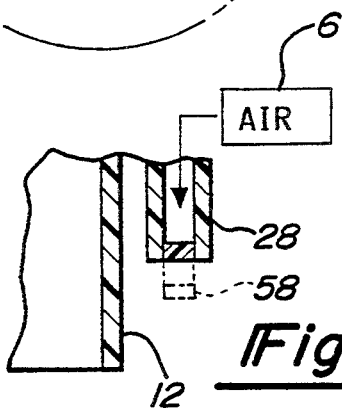
FIG. 4 is a sectional view of a portion of the view shown in FIG. 1 and showing the manner in which an end cap of the grout line is discharged when it is desirable to begin filling in the grout.
Figure 6:
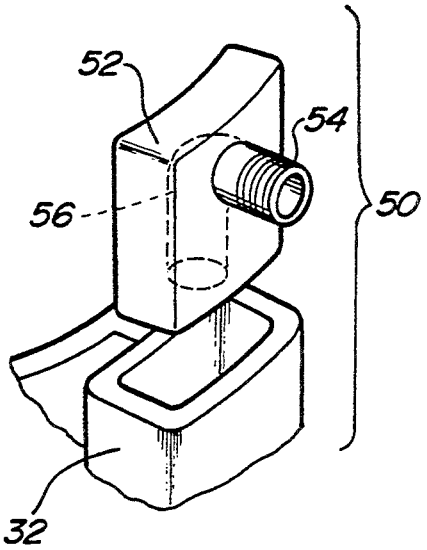
FIG. 6 is a sectional view of a portion of the view shown in FIG. 1 and showing the grout line of the top-most casing section and the manner in which the grout is introduced into the grout line.

Referring to FIG. 4 and to FIG. 6, there are shown both bottom and top views, respectively, of the continuous grout channel formed by the interconnected grout line sections 28–32. Shown in FIG. 6 is an adaptor 50 for permitting the injection of grout through the grout channel. The adaptor 50 is in the shape of a contoured member 52 similar to the internal contour of the uppermost grout line 32 and is insertable within the opening of the grout line. An outlet 54 for receiving a grout supply line, not shown, extends from one side of the adaptor member 52. A channel 56 is formed within the member 52 and communicates the grout to within the grout lines 32, 30 and 28 by succession.

As shown in FIG. 4, a plug 58 is positioned over the opening at the bottom-most grout line 28. The purpose of the plug is to prevent dirt or other impediments from inside the hole from plugging the grout line and impeding the injection of the grout material. Upon complete assembly of the well casing and grout line 10, a source of pressurized air 60 is injected into the grout line, preferably through the outlet 54 described in FIG. 6. The pressurized air blows the plug 58 out of the grout line 28, enabling the grout to be subsequently injected through the grout channel and into the open space between the wall casing and the hole.

As is further shown in FIGS. 1 and 4, the bottom-most end of the grout line 28 is spaced a predetermined distance above the bottom edge of the well casing section 12. The positioning of the grout line 28 ensures that the flow of grout will not be impeded by the bottom 8 of the hole 6 and that the grout will be able to successively fill the hole from bottom to top.

Figure 7:
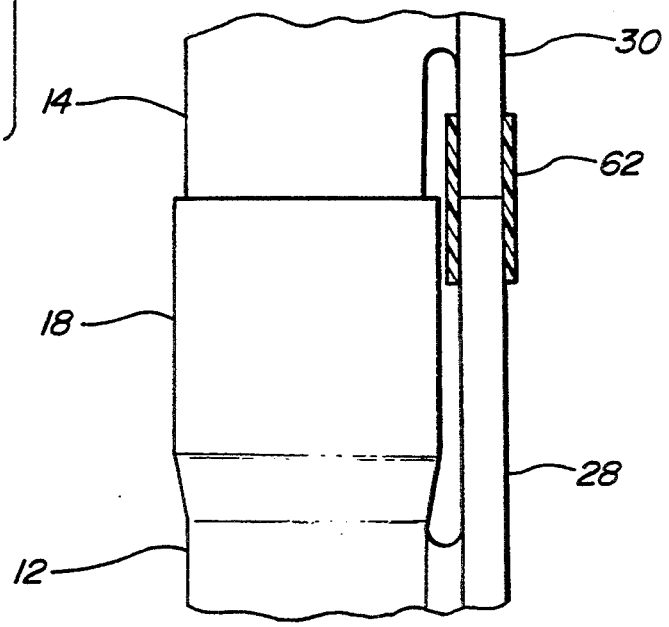
FIG. 7 is a view similar to that shown in FIG. 5 and showing an alternate manner for securing a first grout line with a succeeding grout line.

Referring to FIG. 7, an alternate configuration for securing successive grout lines 28 and 30 is shown. In this configuration, the grout line 28 does not have an outwardly-flared end portion 38. Instead, the opposing ends of both lines 28 and 30 are of the same dimension and come into an abutting contact when the well casing section 14 is inserted into the end 18 of the well casing 12. A coupling 62 replaces the ends 38 and 40 and sealingly engages the grout line 28 to the grout line 30. In this fashion, a continuous grout channel can be obtained with couplings 62 used in the place of the interconnecting arrangement shown in FIG. 5.

Referring again to FIG. 5, an opening in the form of a window 64 may be optionally provided on the grout line 30. The window communicates with the internal grout channel and faces the side of the hole 6. The window 64 is normally covered by a plate 66.

The goal of the invention is to fill the hole with grout from bottom to top in order to satisfy existing industry requirements and to prevent open spaces and cavitations from occurring within space to be filled. However, it is also apparent that the injection pressures required for filling the grout to the top of the hole from the bottom of grout line 28 may prove to be excessive, based upon the depth of the hole. A calculation can then be made as to at what height of grout fill the pressure requirements of filling the grout from the bottom become too burdensome.

The window 64 can then be located at a desired height of the grout channel to act as a grout bypass and to complete the filling of the grout which was begun from the bottom. In this instance, the panel 66 is applied over the window 64 and is secured to the well casing by an adhesive (not shown) or by weakened connections 68. At some point, the buildup of grout pressure within the grout channel will cause the panel 66 to detach from the window 64. Grout will then begin to flow through the window and will fill the hole. Ideally, the filling of the grout through the window 64 will act as a pressure relief so as to pick up at the point where the pressure becomes to great to fill the grout from the bottom.

Figure 8:
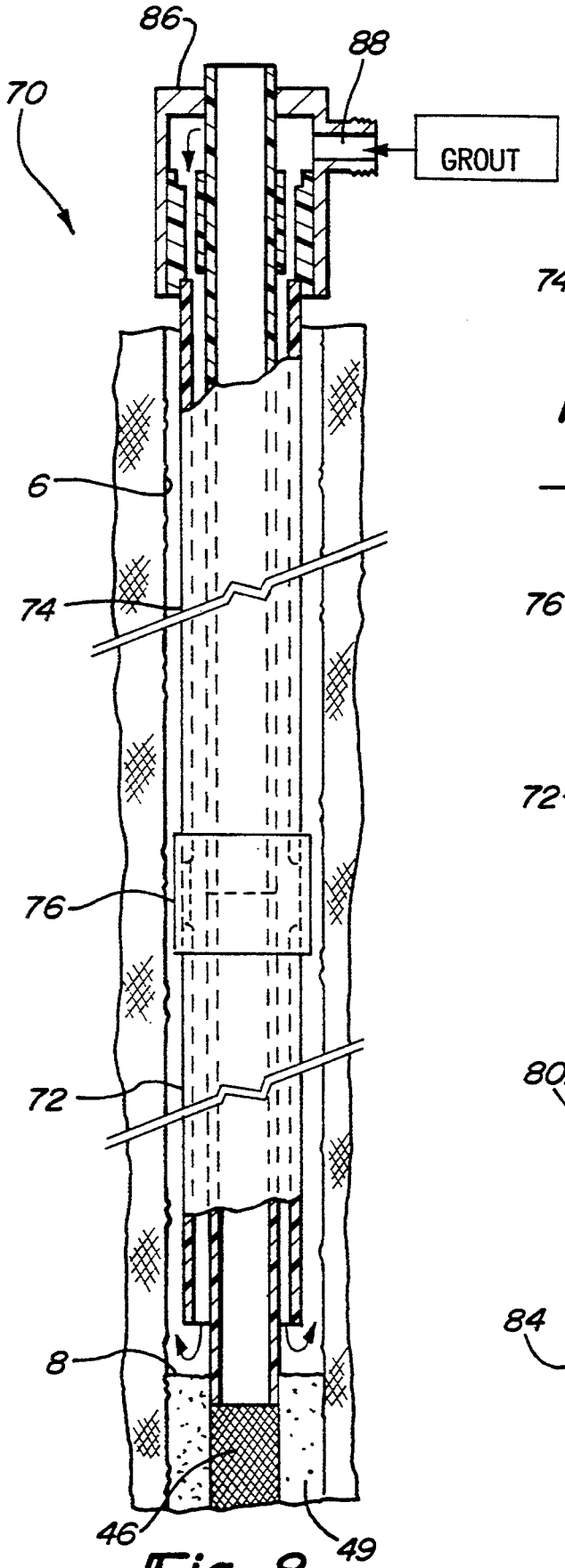
FIG. 8 is an overall view of the assembled grout line for a series of well casings according to a second preferred embodiment of the present invention.
Figure 9:
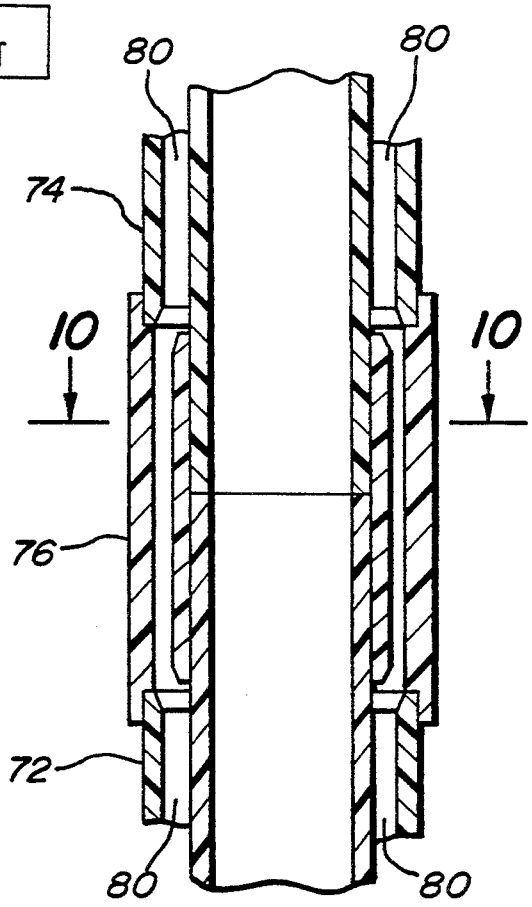
FIG. 9 is a sectional view of a portion of the assembled grout line shown in FIG. 8 and showing the manner in which two succeeding casing sections are interconnected.
Figure 10:
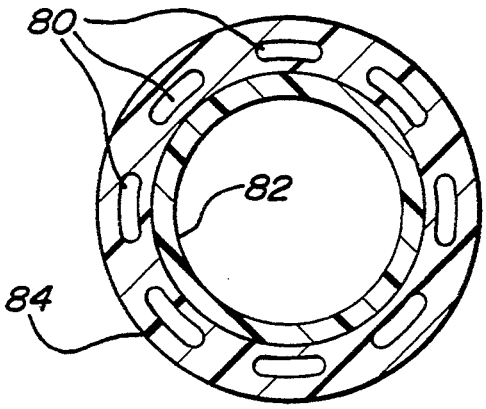
FIG. 10 is a cross section taken along line 10—10 of FIG. 9 and showing the arrangement of the grout channels according to the second preferred embodiment.

Referring to FIGS. 8–10, a second preferred embodiment of the combination well casing and grout line of the present invention is shown at 70. Well casing sections 72 and 74 are shown, interconnected by a coupling element 76. The well casing sections are of a constant dimension end to end, and differ from the casing sections described in FIGS. 1–7. The coupling element 76 secures the end of casing section 72 which comes into an abutting contact with the opposing end of casing section 74. As was previously described, a number of well casing sections can be employed to assemble a well casing of any desired length.

The embodiment of FIGS. 8–10 differs from that disclosed in FIGS. 1–7 in that a plurality of parallel grout channels 80 replace the single grout channel formed by the grout lines 28–32 previously described. Referring specifically to FIG. 10, the plurality of grout channels 80 are formed longitudinally between the inner wall 82 and outer wall 84 of each of the casing sections 72 and 74 and extend the entire length of the attached casing sections 72 and 74. The grout channels 80 are also formed along the longitudinal length of the coupling element 76 which attaches the casing sections 72 and 74 together.

Accordingly, the grout channels 80 extend the entire length of the assembled well casing sections in the same fashion as the single grout channel described in the previous embodiment.

Referring again to FIG. 8, an adaptor unit 86 can be placed over the uppermost end of the casing section 74 and communicates with the grout channels 80. The grout is then injected through an opening 88 in the unit 86 and is communicated with the various channels 80 to discharge at the bottom of section 72 at the bottom of the hole. As was previously described with reference to FIG. 1, the grout channels 80 terminate at a point short of the bottom 8 of the hole 6 to assist the flow of the grout.

Accordingly, the present invention provides a novel and useful manner for incorporating a grout line into a well casing in order to fill the open space between the casing outer wall and the side of the hole dug for the well.

Having described my invention further embodiments for filling in the hole around the well casing with the grouping line will become apparent to those skilled in the art to which the application pertains.

I claim:

1. A combination well casing and grout line for grouting an open space between the well casing and a hole which is dug for a well, comprising:

at least one well casing section, said well casing section being insertable into the hole which is dug for the well;

at least one grout line extending from said well casing section the longitudinal length of said well casing section, said grout line communicating a grouting material from a top of the hole to a bottom of the hole; and said grout lines are each connected by a flange to said well casing sections, said flanges extending substantially the entire length of said grout lines and terminating at opposite ends short of said opposing ends of said grout lines so as to space said grout lines a predetermined distance away from said well casing sections and to permit said grout lines to interattach upon attachment of said well casing sections;

wherein said grouting material progressively fills the open space between the well casing and the hole from the bottom to the top.

2. The invention as described in claim 1, further comprising a plurality of well casing sections and a plurality of grout lines, and a means for attaching said well casing sections and said grout lines end-to-end.

3. The invention as described in claim 2, said means for attaching further comprising an outwardly-flared end portion at a first end of said grout lines and a bottom portion at the other end of said grout lines, said outwardly-flared end of a first grout line receiving a bottom of a second grout line concurrent with assembly of said first and second well casing sections.

4. The invention as described in claim 1, further comprising an adaptor for attachment to an upper end of said grout line, said adaptor providing a supply of grout to said grout line.

5. The invention as described in claim 1, wherein said grout line is a plurality of grout channels said grout channels being formed around the periphery of said well casing section.

6. The invention as described in claim 5, further comprising a plurality of well casing sections with pluralities of peripheral grout channels and a means for attaching said well casing sections and said grout channels end-to-end.

7. The invention as described in claim 6, said means for attaching comprising a coupling, said coupling securing opposing ends of said well casing sections at a spaced distance.

8. The invention as described in claim 5, further comprising an adaptor unit for securing about a top of said well casing section, said adaptor unit feeding the grouting material through said grout channels to the bottom of the hole.

9. The invention as described in claim 1, wherein said grout line terminates a distance short of the bottom of the hole.

10. The invention as described in claim 1, wherein said well casing and said grout line are constructed of a durable synthetic plastic.

11. The invention as described in claim 1, wherein said well casing and said grout line are constructed of PVC plastic.

12. A combination well casing and grout line for grouting an open space between the well casing and a hole which is dug for a well, comprising:

a plurality of well casing sections, said well casing sections being insertable into the hole which is dug for the well; a plurality of grout lines extending from said well casing sections the longitudinal length of said well casing sections, said grout lines communicating a grouting material from a top of the hole to a bottom of the hole; and means for attaching said well casing sections and said grout lines end-to-end, said means comprising an outwardly-flared end portion at a first end of said well casing sections and a bottom portion at the other end of said well casing sections, said outwardly-flared end of a first well casing section receiving a bottom of a second well casing section, and so on;

wherein said grouting material progressively fills the open space between the well casings and the hole from the bottom to the top.

13. The invention as described in claim 12, said means for attaching further comprising a coupling for securing a first end of a said grout line to another end of a succeeding grout line, said first and other ends of said succeeding grout lines coming into abutting contact upon assembly of said well casing sections.

14. A combination well casing and grout line for grouting an open space between the well casing and a hole which is dug for a well, comprising:

at least one well casing section, said well casing section being insertable into the hole which is dug for the well;

at least one grout line extending from said well casing section the longitudinal length of said well casing, said grout line communicating a grouting material from a top of the hole to a bottom of the hole; and a plug covering a bottom end of said grout line and a source of pressurized air applied to said grout line to eject said plug to permit the application of said grouting material;

wherein said grouting material progressively fills the open space between the well casing and the hole from the bottom to the top.

15. A combination well casing and grout line for grouting an open space between the well casing and a hole which is dug for a well, comprising:

at least one well casing section, said well casing section being insertable into the hole which is dug for the well;

at least one grout line extending from said well casing section the longitudinal length of said well casing section, said grout line communicating a grouting material from a top of the hole to a bottom of the hole; and a window formed at a predetermined point in said grout line and a plate covering said window;

wherein said grouting material progressively fills the open space between the well casing and the hole from the bottom to the top.

16. The invention as described in claim 15, wherein said plate has a weakened connection to said grout line, said plate detaching from said window upon a pressure build-up within said grout line to allow said grouting material to flow through said window.

17. A combination well casing and grout line for grouting an open space between the well casing and a hole which is dug for a well, comprising:

a plurality of well casing sections, said well casing sections being insertable into the hole which is dug for the well; a plurality of grout channels formed around the periphery of said well casing sections and extending the longitudinal length of said well casing sections, said plurality of grout channels communicating a grouting material from a top of the hole to a bottom of the hole;

a coupling for securing each of opposing ends of said well casing sections at a spaced distance, said coupling having a plurality of grout channels formed around the periphery of said coupling, said grout channels extending the length of said coupling and communicating said grout channels in a first said well casing section to said grout channels in a second said well casing section;

wherein said grouting material progressively fills the open space between the well casings and the hole from the bottom to the top.

18. A combination well casing and grout line for grouting an open space between the well casing and a hole which is dug for a well, comprising:

at least one well casing section, said well casing section being insertable into the hole which is dug for the well;

at least one grout line extending from said well casing section the longitudinal length of said well casing section, said grout line communicating a grouting material from a top of the hole to a bottom of the hole; and a screen covering a bottom of said well casing section, said screen preventing the grouting material from entering said well casing section;

wherein said grouting material progressively fills the open space between the well casing and the hole from the bottom to the top.

* * * * *